US006989769B2

(12) United States Patent
Gray

(10) Patent No.: US 6,989,769 B2
(45) Date of Patent: Jan. 24, 2006

(54) SAFETY INDEX

(75) Inventor: Anthony James Gray, Edinburgh (GB)

(73) Assignee: MacTaggart Scott (Holdings) Limited, Midlothian (GB)

( * ) Notice: Subject to any disclaimer, the term of this patent is extended or adjusted under 35 U.S.C. 154(b) by 433 days.

(21) Appl. No.: 10/206,727

(22) Filed: Jul. 26, 2002

(65) Prior Publication Data

US 2003/0085807 A1 May 8, 2003

(30) Foreign Application Priority Data

Jul. 28, 2001 (GB) ..... 0118476

(51) Int. Cl.
*G08B 23/00* (2006.01)

(52) U.S. Cl. ..... 340/984; 340/945; 340/973; 244/116; 244/50; 244/182; 701/9; 701/15

(58) Field of Classification Search ..... 340/984, 340/945, 946, 953, 973; 244/116, 50, 17.13, 244/182; 701/9, 15

See application file for complete search history.

(56) References Cited

U.S. PATENT DOCUMENTS 3,690,598 A * 9/1972 Buchholz et al. ..... 244/182
4,071,893 A * 1/1978 Sicre ..... 701/15
4,300,200 A * 11/1981 Doe ..... 702/144
4,488,693 A * 12/1984 Brandt et al. ..... 244/116
5,442,556 A * 8/1995 Boyes et al. ..... 701/9

* cited by examiner

*Primary Examiner*—Jeffrey Hofsass
*Assistant Examiner*—Daniel Previl
(74) *Attorney, Agent, or Firm*—Alston & Bird LLP

(57) ABSTRACT

A method and system is utilized to produce an output corresponding to a safety level, particularly in relation to an activity on a moving body. The method involving producing an output corresponding to the ability to perform an operation within a safe limit on a moving vessel. The method comprising the steps of acquiring real time data from instrumentation on the vessel indicative of first and second elements of vessel motion relevant to the safety of the operation. Processing the data relating to each element of motion. Scaling the data relating to each element to a common scale to provide first and second values relating to the respective elements of vessel motion. Determining which value is of greatest significance and providing a output indicative of the greatest value.

22 Claims, 2 Drawing Sheets

SAFETY INDEX

BACKGROUND OF THE INVENTION

The present invention relates primarily to a method and system for producing an output corresponding to a safety level, particularly in relation to an activity on a moving body. One embodiment of the present invention relates to a method and system for producing an output indicative of a safety level for a vessel at sea, such that a user may assess the data produced to determine if a task can be performed within a safe working limit.

Personnel responsible for the safety and security of aircraft aboard warships have for many years relied on roll and pitch limits to form the basis of information to determine if tasks can be performed within a safe operational window. It is known that these limits are in some cases over restrictive, as in times of emergency they have been exceeded without incident.

Attempts to expand the operational window by providing alternative and more detailed information in the form of data relating to the heading of the vessel to the waves (also termed wave encounter angle), along with that of roll and pitch limits, or by providing data based on speed-polar plots and sea state have, in the main, proved unsuccessful, because users have been unable to readily and objectively interpret the data supplied to them.

In particular, speed-plots suffer front a number of limitations, the greatest of which is the subjective determination of sea state, based on an estimation of wave height and direction. Other variables can also affect the validity of the speed-plot: the models used in the ship motion program to generate speed-plots are formulated from idealistic models, and do not account for changes in, for example, the ship mass, centre of gravity, trim, and stabiliser response.

SUMMARY OF THE INVENTION

It is amongst the objects of embodiments of the present invention to obviate or at least mitigate one of the aforementioned disadvantages.

According no a first aspect of the present invention, there is provided a method of indicating a value, said method comprising the steps of:

acquiring data from a body indicative of at least first and second variables;

processing the data relating to each variable;

scaling the data relating to each variable to a common scale to provide at least first and second values relating to each variable;

determining which value is of greatest significance; and providing an output indicative of said most significant value.

According to a second aspect of the present invention there is provided a method of producing an output corresponding to the ability to perform an operation within a safe limit on a moving vessel, said method comprising the steps of:

acquiring real time data from instrumentation on said vessel indicative of at least first and second elements of vessel motion relevant to the safety of the operation;

processing the data relating to each element of motion;

scaling the data relating to each element to a common scale to provide at least first and second values relating to the respective elements of vessel motion;

determining which value is greatest; and providing an output indicative of said greatest value.

In one application, the output value is intended to serve as an objective indication of the safety of carrying out a particular task or action. For example, on a sea-going vessel, the output value may be utilised an a guide as to whether it is safe to launch a smaller boat from the vessel, whether it is safe to initiate or continue with a replenishment-at-sea (RAS) operation or whether it is safe for a helicopter to be manoeuvred on the deck of the vessel. The output thus removes much of the subjectivity which is present in such decisions at present, and which generally causes personnel to err on the side of caution, such that many tasks or operations which could have been carried out in safety are subject to unnecessary delay or cancellation.

The outputting of a single value, corresponding to the greatest or other wise most significant value simplifies analysis of the output by a user. Off course the scaling of the data is selected such that the scaled values are weighted in a manner which reflects the safety impact of the respective data.

The data will typically be processed by computer utilising the acquired data, stored constants and other variables relevant to the operation.

In certain embodiments, the method may involve providing details of another object which will interact with the vessel or otherwise be affected by the motion of the vessel. For example, where the value is to be used to indicate whether it is safe for a helicopter to be manoeuvred on the deck of a sea-going vessel, details of the helicopter's mass and restraint model may be supplied.

Conveniently, the common scale is in the form of an index, selected such that a predetermined point or value on the index is indicative of a certain level of probability of an incident or, particularly with reference to the second aspect, a motion induced interruption (MII). In one example, an index number of 1 indicates a likelihood of an incident or MII, and the index number output is preferably illustrated graphically. However, the value may be presented in one or a variety of ether forms, including a different numerical range, or some other visual indication, for example as a colour shade or intensity, or as one or more sounds.

Preferably, the output is a visual cue.

Preferably, the output displays the greatest values obtained over a period of time, such that a user can readily ascertain the pattern of values over a preceding time interval. In many situations, this will assist a user in predicting likely future values. In certain embodiments of the invention, preceding values may be analysed to predict the likelihood of certain events. For example, for a sea-going vessel these events may include a wave slam, a wave breaking over the bows, or even the likelihood of sea-sickness in the crew or passengers in a part of the vessel, this being related primarily to vertical acceleration of the vessel.

In addition, or alternatively, the output may be a control signal, which may be used to, for example, "lock down" equipment when the likelihood of an MII is high, or sound an alarm when it is predicted that a wave is likely to break over the bows.

Conveniently, the instrumentation is dedicated equipment that is placed at the area of interest, for example on the flight deck of a vessel where the output is used to indicate whether it is safe for a helicopter to be manoeuvred. Alternatively, data is acquired from general instrumentation, and a model is then used to determine the vessel's equations of motion at the desired location.

The data acquired obviously varies depending on the particular application of the method. For the preferred applications relating to aircraft handling on sea-going vessels, work carried out on behalf of the applicant has established that when relying on roll and pitch limitations, lateral acceleration has the largest influence on aircraft instability, vertical acceleration and roll having a secondary contribution, and pitch the weakest contribution; traditional roll and pitch indicators provide no indication of these acceleration values. Accordingly, the preferred embodiments of the invention utilise sensors for determining lateral and vertical acceleration, in addition to pitch and roll sensors. Thus, it has been demonstrated that aircraft instability is due to a combination of more than just roll and pitch, and that an unsafe working condition can occur when neither roll or pitch is at its maximum. While notice of such conditions would not be available using existing roll and pitch indicators, the preferred embodiment of the present invention processes the additional acceleration data, and by appropriate scaling can provide a readily understood output, which takes account of the relevant ship movement parameters.

BRIEF DESCRIPTION OF THE DRAWINGS

An embodiment of the present invention will now be described by way of example with reference to the accompanying drawings, in which.

DETAILED DESCRIPTION OF PREFERRED EMBODIMENTS

Figure 1A:
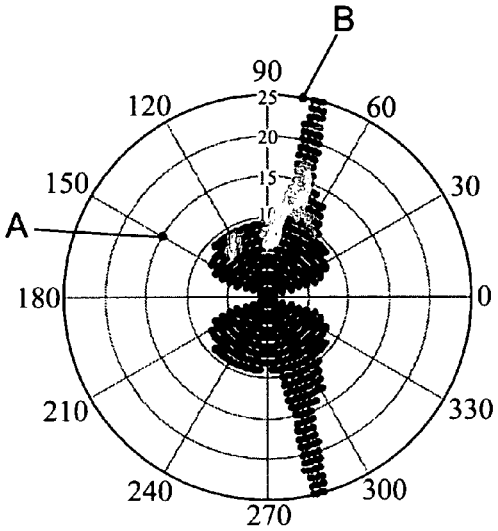
FIGS. 1*a* to 1*c* show typical representations of speed-polar plots for different situations.
Figure 1B:
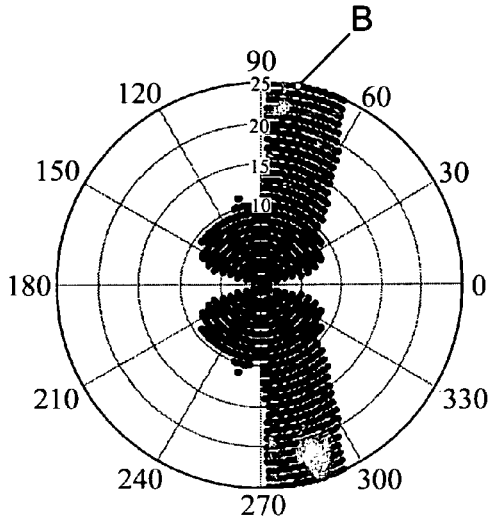
Figure 1C:
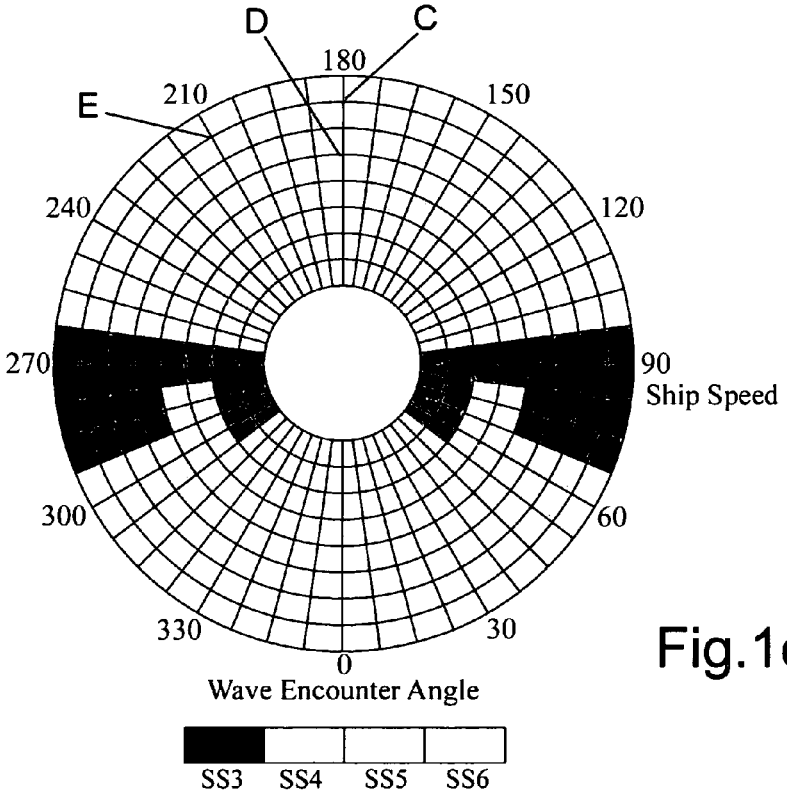

Referring firstly to FIGS. 1*a*, 1*b* and 1*c* there is shown a number of prior art representations in the form of speed-polar plots representing different characteristics for various MII events. FIGS. 1*a* and 1*b* are characteristic speed-polar plots for the MII of vertical oleo (wheel support strut) force exceedance, for a helicopter, in a given sea state with a given wind velocity, for exposure times of thirty minutes and ten hours, respectively.

Referring to FIGS. 1*a* and 1*b*, the numbers around the circumference of the outer circle represent. The heading of the vessel to the waves. The set of numbers along the vertical line, extending between the centre and 90°, at the top of the diagram, and which are placed next to the intersections of the circles and the vertical line, represent the speed of the vessel. Thus each progressively larger circle represents the vessel travelling at a faster speed. Therefore a vessel travelling at a speed of 15 knots on a heading of 150° to the waves would be located at position A in the polar plot of FIG. 1*a* Likewise a vessel traveling on a heading of 80° to the waves at a speed of 25 knots would be represented by B in FIGS. 1*a* and 1*b*. However, as can be seen, the speed polar plot of FIG. 1*b* indicates the unacceptably high likelihood of an occurrence of an MII for vertical oleo force exceedance, that is to say a leg of the helicopter will leave the flight deck or the helicopter may slice across the flight deck due to a reduced frictional contact between the helicopter wheels and the flight deck. It should be noted that the only differing parameter in the two polar plots of FIGS. 1*a* and 1*b* is the exposure time, that is thirty minutes or ten hours for a given sea state and wind velocity.

Similar plots such as those depicted in FIGS. 1*a* and 1*b* may be superimposed to provide a speed-polar plot covering all limiting parameters of interest for a to particular aircraft on a vessel, such as: wheel reaction; main and nose tyre deflection; wheel lift; aircraft slide; maximum static roll and pitch angles, and towing force.

Speed-polar plots may also be provided for a given probability, or exposure time, showing limiting sea states at which any one of the MIIs is likely to occur, as depicted in FIG. 1*c*. FIG. 1*c* is characteristic of a speed-polar plot that identifies the limiting sea states at which any MII may occur. In this example, the darkest areas indicate headings and speeds at which the upper limit of safe operation is sea state 3. Progressing from the darkest shade to into lightest shade, white is reached, which indicates the more limited headings and speeds available for safe operation in sea state 6.

The speed-polar plot of FIG. 1*c* is formed by concentric circles, the innermost circle representing the slowest speed of a vessel and the outermost circle the fastest speed of a vessel. The numbers around the circumference of the outermost circle indicate wave encounter angle with respect to the vessel. The different shadings represent different sea states, the sea stave being a variable determined by a user in accordance with certain observed criteria. However, the determination of sea state is subjective, as is determination of wave encounter angle. There are thus two variables that a user has to subjectively determine in order to use the speed-polar plot.

To demonstrate the use of the plot, if for example a vessel was travelling on at a speed of 30 knots with a wave encounter angle of 180°, represented by 'C', then safe operations could be performed an sea conditions up to sea state 3. If the speed of the vessel were to be reduced to 20 knots, represented by 'D', then safe operators could be performed in conditions up to sea state 4, or if the speed of the vessel was maintained but heading of the vessel was changed such that the wave encounter angle was 210°, represented by 'E', then safe operations could be performed in conditions up to sea state 6.

Reference has been made above to performing a sate operation, however any given speed-polar plot only represents a single operation. Therefore, each individual activity or operation, and each piece of equipment likely to be used in the activity or operation, will need to have a speed-polar plot created relating thereto.

Thus, to make effective use of speed-polar plots it is necessary to keep a number of these plots relating to each different operation, and for the person responsible to select the appropriate plot, as well as subjectively determine the seat state and wave encounter angle, before predicting whether it is safe to perform a selected operation. In one example, a flight deck officer on a naval vessel will have to have access to plots related to a number of activities likely to take place on the flight deck, and for each activity involving a helicopter well have to have access to plots relating to the different aircraft types which may have to be handled on the flight deck.

Figure 2:
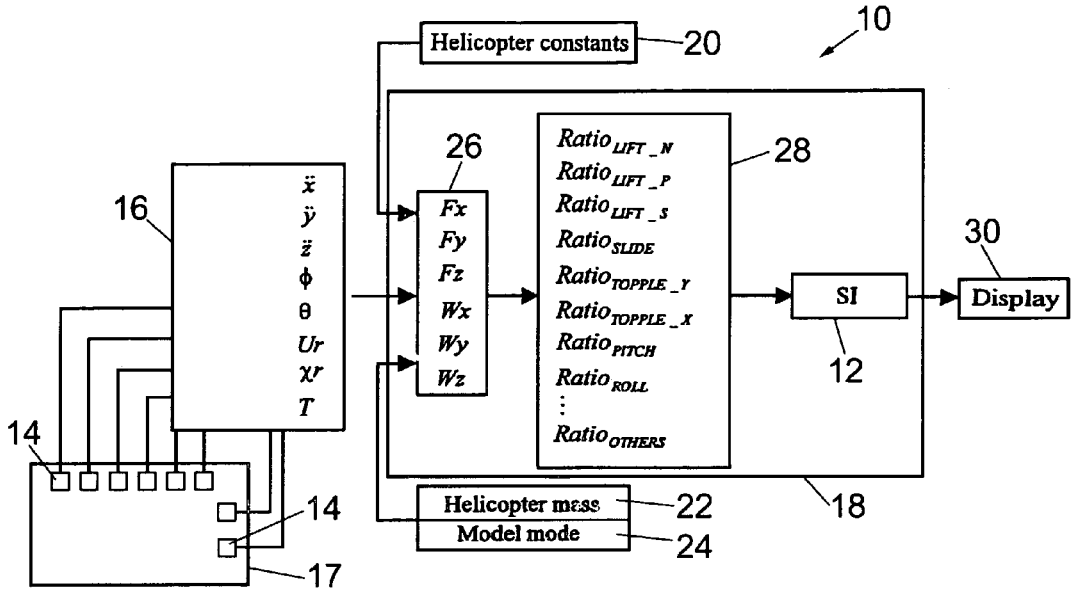
FIG. 2 shows a block diagram illustrating the operation of a system for producing an output corresponding to a safety level in accordance with an embodiment of the present invention.

Reference is now made to FIG. 2 of the drawings, which illustrates the operation of a system 10 for producing an output 12 corresponding to a safety level, in accordance with a preferred embodiment of the present invention. As will be described, the system 10 provides a user with an easily understood output 12 so that a user can then decide, based on substantially objective criteria, whether it is safe to perform a particular operation, in this example the movement of a helicopter across the flight deck of a sea-going vessel.

The system 10 comprises a number of sensors 14 for gathering data 16 on various aspects of the movement of the vessel 17, and then forwarding this data to a processor 18. As will he described, the data 16 is processed in combination with, relevant geometric constants of a particular helicopter 20, together with the helicopter-related variables in the form of the helicopter mass 22 (related to fuel and weapons load, number or personnel on board and the like) and the helicopter's restraint model 24, that is whether the helicopter is restrained or not. The data is individually processed in relation to criteria relevant to aircraft safety, and the processed information relating to each criterion is scaled and then filtered to produce a single output 12. As will be described, the output 12 is indicative of only the most significant individual criterion at that time.

The output 12 in this example is a scaled value which has limits of 0 and 1, 0 representing an absolute safe limit and 1 a situation where a motion induced interruption (MII) is imminent. This provides a user with an easily understandable single output which, in this example, can be used to determine if it is safe to move a helicopter from a hangar to a flight deck on a vessel underway at sea, or if the vessel's movements necessitate the need for the aircraft to be restrained or operations terminated.

In use, this embodiment measures the movements of the vessel 17 via sensors 14, so as to determine directly the vessel's equations of motion. The data 16 obtained from the sensors 14 is then used in combination with the helicopter's details 20, 22, 24, the constants related to a particular helicopter type being determined by the user selecting the appropriate helicopter type from a menu of options, and the variables (aircraft mass and whether the aircraft is restrained or not, and if restrained the type of restraints used), being entered/selected by the user. The data 16 is then processed to produce a set of values 26 representative of the forces acting upon the aircraft 20. In this embodiment, gravitational and acceleration forces $F_x$, $F_y$, $F_z$ and wind forces $W_x$, $W_y$, $W_z$ are calculated. The calculated values are then used to calculate a set of limiting criteria 28 in the form of a set of ratios relating to slide, topple in roll, topple in pitch, roll angle and pitch angle for the aircraft 20. The dominant or highest ratio of the set of limiting criteria 28 is selected as the value to be output, and is shown on a display 30.

Figure 3:
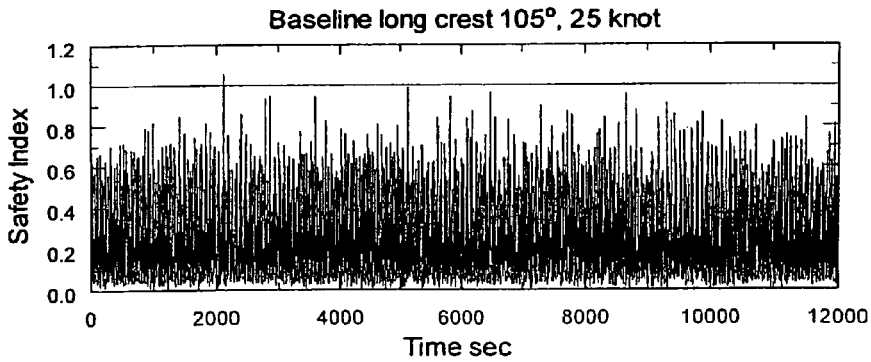
FIG. 3 shows a typical output of the system of FIG. 2.

Referring now to FIG. 3, there is shown an example of the output of the system 10, as shown on the display 30. The display presents a set of information for a period of time so that the user may obtain a readily comprehended visual indication of recent conditions. It can be seen in this extract that there has been one occurrence in the recent past where the output 24 has been greater than one, indicating the possible or likely occurrence of an MII for the selected operation.

The sensors 14, which comprise accelerometers, inclinometers and the like, are ideally placed close to the object and area in which the activity is to be performed, so as to obtain data for the movement of the vessel as close to the point of activity as possible. Accordingly, in this embodiment the sensors 14 would preferably be located on or adjacent the flight deck.

In calculating the limiting criteria 28, it is first necessary to determine frictional contact values for the helicopter: for a helicopter on a flight deck, it is necessary to calculate the reaction forces at the helicopter wheels. The reaction at any wheel may be compared to the static reaction of the helicopter at equilibrium, whilst the dynamic reactions at the nose wheel, the port side wheel and the starboard side wheel $R_n$ (t), $R_p$(t), $R_s$ (t) are given by:

$$2R_n(t) = -\frac{(zd_\mu Fx + zd_{cp}Wx) + Fz(x_{mwc} - xd_s) + (x_{mwc} - xd_{cp})Wz}{x_{mwc}},$$

$$\text{if } R_n(t) < 0 \text{ then } R_n(t) = 0$$

$$R_p(t) = -\frac{(zd_\mu Fy + zd_{cp}Wy) + Fz(y_{mwc} - yd_s) + y_{mwc}(Wz + 2R_n(t))}{2y_{mwc}},$$

$$\text{if } R_p(t) < 0 \text{ then } R_p(t) = 0$$

$$R_s(t) = -2R_n(t) - R_p(t) - Fz - Wz, \text{ if } R_s(t) < 0 \text{ then } R_s(t) = 0$$

Calculation of Frictional Contact

Of interest is the point at which a wheel reaction reaches zero. Mathematically, if the reaction is less than zero then the wheel lifts clear of the deck. In practice, the weight of the wheel assembly (which is ignored for practical purposes) will allow the oleo to extend a considerable distance keeping the wheel on the deck, but with a minimal reaction. This situation is loosely termed wheel lift but is more correctly described as the point at which the wheel loses frictional contact. The ratio of nose lift is:

$$\text{Ratio}_{LIFT_N} = \frac{R_n - R_n(t)}{R_n} \tag{1}$$

If there is no load from ship motion or wind then $\text{Ratio}_{LIFT_N}=0$.

$\text{Ratio}_{LIFT_N}$ increases with increasing ship motion and wind. At the point at which the nose wheels are about to lift $\text{Ratio}_{LIFT_N}=1$.

$0 \leqq \text{Ratio}_{LIFT_N} \leqq 1$ is a measure of how near the nose wheels are to losing frictional contact.

Similarly for the main wheels:

$$\text{Ratio}_{LIFT_P} = \frac{R_p - R_p(t)}{R_p} \tag{2}$$

$$\text{Ratio}_{LIFT_s} = \frac{R_s - R_s(t)}{R_s} \tag{3}$$

Calculation of Slide

The ratio of lateral force to frictional resistance for sliding is given by:

$$\text{Ratio}_{SLIDE} = \frac{\sqrt{(Fx + Wx)^2 + (Fy + Wy)^2}}{\mu(2R_n(t) + R_p(t) + R_s(t))} \tag{4}$$

If there is no load from ship motion or wind then $\text{Ratio}_{SLIDE}=0$.

$\text{Ratio}_{SLIDE}$ increases with increasing ship motion and wind. At the point at which the aircraft is about to slide $\text{Ratio}_{SLIDE}=1$ For $\text{Ratio}_{SLIDE}>1$ the aircraft will always slide. If $\text{Ratio}_{SLIDE}>0$ then the vertical forces are sufficient to lift the aircraft off the deck.

$0 \leqq \text{Ratio}_{SLIDE} \leqq 1$ is thus a measure of how near the aircraft is to sliding.

Calculation of Topple in Roll

The ratio of overturning moment to righting moment for toppling in the roll direction is given by:

$$\text{Ratio}_{TOPPLE_Y} = \frac{|zd_{\mu}Fy + zd_{cp}Wy|}{-(y_{mwc} \pm yd_{\mu})Fz - y_{mwc}Wz} \quad (5)$$

In a similar manner to sliding $\text{Ratio}_{TOPPLE_y}$ will increase with proportionately higher toppling moment. At the point at which the aircraft is about to topple $\text{Ratio}_{TOPPLE_y}=1$. For $\text{Ratio}_{TOPPLE}>1$ the aircraft will always topple.

$0 \leqq \text{Ratio}_{TOPPLE_y} \leqq 1$ is thus a measure of how near he aircraft is to toppling in roll.

Calculation of Topple in Pitch

The ratio of overturning moment to righting moment for toppling in the pitch direction is given by:

$$\text{Ratio}_{TOPPLE_X} = \frac{|zd_{\mu}Fx + zd_{cp}Wx|}{-(x_{mwc} - xd_{\mu})Fz - (x_{mwc} - xd_{cp})Wz} \quad (6)$$

As with toppling in roll, $\text{Ratio}_{TOPPLE_x}$ will increase with proportionately higher toppling moment. At the point at which the aircraft is about to topple $\text{Ratio}_{TOPPLE_x}=1$. For $\text{Ratio}_{TOPPLE_x}>1$ the aircraft will always topple.

$0 \leqq \text{Ratio}_{TOPPLE_x} \leqq 1$ is thus a measure of how near the aircraft is to toppling in pitch.

Calculation of Limiting Roll Angle

The ratio of Limiting roll angle to actual roll angle is given by $$\text{Ratio}_{ROLL} = \frac{|\phi_{MEASURED}|}{|\phi_{LIMIT}|} \quad (7)$$

$0 \leqq \text{Ratio}_{ROLL} \leqq 1$ is thus a measure of how near the aircraft is to reaching its roll limitation.

Calculation of Limiting Pitch Angle

The ratio of limiting pitch angle to actual pitch angle is given by:

$$\text{Ratio}_{PITCH} = \frac{|\theta_{MEASURED}|}{|\theta_{LIMIT}|} \quad (8)$$

$0 \leqq \text{Ratio}_{PITCH} \leqq 1$ is thus a measure of how near the aircraft is to reaching its pitch limitation.

If any one or the eight ratios above, equations 1 to 8, is $\geqq 1$ then the aircraft has reached a limit (or an MII). Taking the maximum value of all the ratios at any time t then gives a simple measure between 0 and 1 of the approach of any MII.

The system 10 identifies the largest of the eight ratios an any one time, and displays only this ratio or value, which may thus be viewed as a "safety index".

It is known that the value of the calculated ratios will be sensitive to variations such as helicopter characteristics, wind speed, wind direction, temperature, sea state and friction. However the variations can be readily accommodated by taking worse case settings; in this way there is always a safety factor in calculating the output 12.

It will be appreciated that various modifications may be made to the embodiment hereinbefore described without departing from the scope of the invention. For example, the output from the system may be a control signal which is used to lock down equipment when the safety index is high and therefore the likelihood of a MII is high. The output signal may further be selected to relate to different activities in different locations of the vessel, the activity and location being further parameters that the user may input to the system or select from a system menu. The sensors may be independent of the existing vessel instrumentation and sensors. Alternatively, the data may be provided by existing vessel instrumentation, and an appropriate model used to determine the equations of motion at a desired location, for example on a flight deck, at a boat-launching davit, or at a replenishment at sea (RAS) station.

It will be appreciated that a principal advantage of the above-described embodiment is that the above system and\or method can be used to maximise operational time aboard a moving vessel, by providing objective and readily comprehended safety information. Furthermore, the operation of the preferred system is entirely independent of ship type, heading to the waves, speed or sea state, and thus does not require the system to be based on specially constructed theoretical "ideal" models, nor on subjective interpretation of current conditions.

what is claimed is:

1. A method of generating an output signal corresponding to the ability to perform an operation within a safe limit on a moving vessel, said method comprising the steps of:

acquiring real time data from instrumentation on said vessel indicative of at least first and second elements of vessel motion relevant to the safety of the operation;

individually processing the data relating to each element of motion;

scaling the data relating to each element to a common scale to generate at least first and second scaled data signals relating to the respective elements of vessel motion;

processing said scaled data signals to determine which scaled data signal is of greatest significance to the safety of the operation; and providing an output signal indicative of said most significant scaled data signal.

2. The method of claim 1 wherein the moving vessel is a sea-going vessel.

3. The method of claim 1, wherein the method involves providing details of another object which interacts with the vessel.

4. The method of claim 1 comprising acquiring real time data from dedicated instrumentation located at an area of interest on the vessel.

5. The method of claim 1 comprising acquiring real time data from general instrumentation, and utilising a model to determine the vessel's equations of motion at a desired location based on said data.

6. The method of claim 1 comprising acquiring data from sensors to determine lateral and vertical acceleration.

7. The method of claim 1 comprising acquiring data from sensors to determine pitch and roll.

8. The method of claim 1 wherein the output signal indicative of said most significant scaled data signal indicates the degree of risk associated with a particular action.

9. The method of claim 1 comprising utilising the output signal indicative of said most significant scaled data signal as a safety guide.

10. The method of claim 1 wherein the scaling of the data is selected such that the scaled data signals are weighted in a manner to reflect the safety impact of the respective data.

11. The method of claim 1 the data is processed by computer utilising the acquired data and at least one of stored constants and other variables.

12. The method of claim 1 wherein the common scale is an index, selected such that a predetermined value on the index is indicative of a level of probability of an incident.

13. The method of claim 12 wherein an index number of 1 indicates a likelihood of an incident.

14. The method of claim 1 wherein the output signal indicative of said most significant scaled data signal is illustrated graphically.

15. The method of claim 1 wherein the output signal indicative of said most significant scaled data signal is presented as at least one of a numerical range, a colour shade, a colour intensity, a sound, and a plurality of sounds.

16. The method of claim 1 wherein the output signal indicative of said most significant scaled data signal is a visual cue.

17. The method of claim 1 wherein output signals are displayed indicative of said most significant scaled data signals obtained over a period of time, such that a user can readily ascertain the pattern of scaled data signals over a preceding time interval.

18. The method of claim 1 comprising analysing preceding scaled data signals to predict the likelihood of certain events.

19. The method of claim 1 wherein the output signal is a control signal.

20. The method as claimed in claim 19 wherein the control signal is used to lock down equipment.

21. The method as claimed in claim 19 wherein the control signal is used to activate an alarm.

22. An apparatus for generating an output signal corresponding to the ability to perform an operation within a safe limit on a moving vessel, said apparatus comprising:

means for acquiring real time data from instrumentation on said vessel indicative of at least first and second elements of vessel motion relevant to the safety of the operation;

means for individually processing the data relating to each element of motion;

means for scaling the data relating to each element to a common scale to generate at least first and second scaled data signals relating to the respective elements of vessel motion;

means for processing said scaled data signals to determine which scaled data signal is of greatest significance to the safety of the operation; and means for providing an output signal indicative of said most significant scaled data signal.

* * * * *